US006055837A

United States Patent [19]

Nishino et al.

[11] Patent Number: 6,055,837

[45] Date of Patent: May 2, 2000

[54] METHOD FOR ROLLING SHAPE STEEL HAVING FLANGE AND WEB, AND ROLLING MILL LINE FOR THE SAME

[75] Inventors: Taneharu Nishino; Kazushige Ikuta, both of Futtsu; Hiroshi Yamane, Kimitsu; Shinya Hayashi, Futtsu; Hiroshi Yamashita, Sakai, all of Japan

[73] Assignee: Nippon Steel Corporation, Tokyo, Japan

[21] Appl. No.: 08/727,382

[22] PCT Filed: Feb. 16, 1996

[86] PCT No.: PCT/JP96/00349

§ 371 Date: Oct. 15, 1996

§ 102(e) Date: Oct. 15, 1996

[87] PCT Pub. No.: WO96/25248

PCT Pub. Date: Aug. 22, 1996

[30] Foreign Application Priority Data

Feb. 16, 1995 [JP] Japan ..... 7-028514

[51] Int. Cl.[7] ..... B21B 13/10

[52] U.S. Cl. ..... 72/225

[58] Field of Search ..... 72/225, 227, 224, 72/250, 234, 229

[56] References Cited

U.S. PATENT DOCUMENTS 3,854,315 12/1974 Winkler ..... 72/227

FOREIGN PATENT DOCUMENTS 56-111501 9/1981 Japan .
58-135705 8/1983 Japan .
2-6001 1/1990 Japan .
2-151302 6/1990 Japan .
4-100600 4/1992 Japan .
4-100602 4/1992 Japan .
4-157011 5/1992 Japan .
4-224011 8/1992 Japan .
5-7911 1/1993 Japan .

OTHER PUBLICATIONS

Patent Abstracts of Japan, vol. 014, No. 379 (M–1012), Aug. 16, 1990 & JP 02 142602 A (Kawasaki Steel Corp).

*Primary Examiner*—Rodney A. Butler
*Attorney, Agent, or Firm*—Kenyon & Kenyon

[57] ABSTRACT

A horizontal roll guide device HG or a friction guide device FG is disposed in front, and in the proximity, of a finish universal mill FU of a rolling process of a shape steel having a flange and a web so as to restrict the center portion of the web in the transverse direction, the finish universal mill includes barrel width-variable horizontal rolls 1*a* and 1*b*, and axes XV of vertical rolls 2*a* and 2*b* are moved by a distance d on the entry side of the rolling direction relatively to the axes XH of the barrel width-variable horizontal rolls 1*a* and 1*b* to as to restrict the web. Due to the synergistic effect of these two restriction effects, web curving and web off-center of the web when the web of the shape steel is rolled from axial direction by the vertical rolls 2*a* and 2*b* by setting the roll width of the barrel width-variable horizontal rolls can be restricted. Accordingly, a variety of shape steels having a flange and various web heights can be produced very accurately.

4 Claims, 7 Drawing Sheets

: INFLUENCE RANGE OF WEB RESTRICTION FORCE WR1

METHOD FOR ROLLING SHAPE STEEL HAVING FLANGE AND WEB, AND ROLLING MILL LINE FOR THE SAME

TECHNICAL FIELD

This invention relates to a method of producing a shape steel having a flange and a web by rolling, and a rolling mill line. More particularly, this invention relates to a rolling method for producing, dividedly and very accurately, H-shaped steels or steels having analogous shapes, having diversified web heights, by a universal mill including vertical rolls whose axes are moved towards the delivery side of a rolling direction with respect to the axes of horizontal rolls, and a rolling mill line for such a rolling method.

BACKGROUND ART

Shape steels having a flange and a web, such as an H-shaped steel, are produced generally through the steps of rough rolling by a breakdown mill, intermediate rolling by a universal rolling mill and finish rolling. Since this method uses horizontal rolls having the same barrel width in the same series, an inner width $W_B$ of an H-shaped steel is constant as shown in FIG. 4(*a*). When a flange thickness $t_F$ is different, a web height (outer width) W changes with this thickness, the web height becomes different even in the same series, and it is only one set of sizes whose nominal size and web height coincide in each of the standards (JIS, ASTM, BS, DIN, etc). On the other hand, when beams of a building structure are produced by mutually bonding rolled H-shaped steels of several sizes inside the same series, there occurs the disadvantage for the execution because one of the flange outer surfaces is generally registered and deviation twice the difference of the flange thickness occurs in the other. In the case of reinforced concrete building structures, the dimension of the post or the beam is limited by a shell dimension. Therefore, when the conventional rolled H-shaped steels are used, a concrete cladding thickness varies with the size and this is disadvantageous from the aspect of design, too. Therefore, the conventional rolled H-shaped steels are not convenient to use in some cases depending on the applications such as coupling between the post and the beam, between the beam and the beam, between the post and the post, etc, of a building. Therefore, production of rolled H-shaped steels having a constant web height (outer width) W in the same series as shown in FIG. 4(*b*) has been earnestly desired.

Means for regulating the web height of the H-shaped steels in the same rolling time is described in Japanese Examined Patent Publication (Kokoku) No. 1-47241 and in Japanese Unexamined Patent Publication (Kokai) No. 2-6001. Namely, these references disclose a method of reducing the inner width of the web of an intermediate rolled material after rolling by a rough universal mill at the stage of finish rolling. This is the rolling method characterized in that a finish universal mill equipped with a pair of upper and lower horizontal rolls having a variable barrel width and a pair of right and left vertical rolls is disposed, and when an intermediate rolled material passes through this universal mill, the portion of the intermediate rolled material corresponding to the web is rolled down in the transverse direction by the vertical rolls of the finish universal mill so as to adjust the web height of the intermediate rolled material. This mill is produced by modifying the pair of upper and lower horizontal rolls of a conventional so-called "universal mill" so that the barrel width can be varied, and this method is practical means which makes it possible to adjust the web height of the H-shaped steels by a relatively economical equipment investment.

However, the web portion has a relatively large ratio of the width $W_B$ to the thickness $t_W$ ($W_B/t_W$: slenderness ratio). Therefore, when the rolling reduction quantity of the web in the transverse direction (web width reduction quantity) is increased, the web undergoes curving or buckling as shown in FIGS. 5(*a*) and 5(*b*), and excessive metal occurring due to the reduction of the web width is likely to exist non-uniformly in the proximity of the joint portion (fillet portion) between the web and the flange. In consequence, the local increase of the plate thickness occurs, and non-uniformity of the product plate thickness in the section (plate thickness error $\Delta_t = t_{Wmax} - t_{Wmin}$) occurs as in the example shown in FIG. 6.

In the extreme case, folding PL of the fillet portion occurs as shown in FIG. 7. Further, because restriction of the rolled material by the vertical rolls proceeds to restriction by the horizontal rolls, the guiding operation of the material to the normal position by the horizontal rolls drops, so that the off-center e of the web (web off-center: $|F_1 - F_2|/2$) is deteriorated as shown in FIG. 8 due to a synergistic operation with buckling of the web. As labor saving and automation on the construction site have made a progress in recent years, dimensional accuracy required for the rolled H-shaped steels as the construction material has become higher, and higher accuracy has been particularly required for an off-center of the web.

The problem of shaping described above can be improved to a certain extent by improving guidance accuracy of the intermediate rolled material to the finish universal mill by the mere contrivance of the guide, and by applying any contrivance to the overall elongation balance by regulating the rolling reduction ratio of the flange at the finish universal mill. However, because the web width reduction quantity cannot be much increased, in practice, by the basic mechanism of shaping, the functions of the barrel width-variable rolls cannot be fully exploited even when such rolls are disposed. Therefore, there remains the problem that not only the assorted production of the web inner widths between a plurality of series cannot be made, and the web heights in the same series cannot be made constant by the same roll set, either, in the series having a large range of flange thicknesses.

To solve the problem described above, the Applicant of the present invention previously proposed a technology in Japanese Unexamined Patent Publication (Kokai) No. 4-100602. This rolling method moves the axes of the vertical rolls of the finish universal mill towards the delivery side of the rolling direction relatively to the axes of the barrel width-variable horizontal rolls, and reduces the inner width of the web while the web of the intermediate rolled material is being restricted by the barrel width-variable horizontal rolls. According to this means, an off-center of the web can be restricted by the web restriction effect of the barrel width-variable horizontal rolls during the web width reduction by the vertical rolls, and the excessive metal occurring due to the reduction of the web width is allowed to fluidize relatively easily in the longitudinal direction by the web elongation promotion effect by rolling of the flange on the delivery side of rolling, so that non-uniformity of the product sheet thickness inside the section can be prevented and eventually, assorted production of web heights, having a large value to a certain extent, can be carried out very accurately. However, this rolling method still involves limits.

In other words, as the web width reduction quantity becomes greater, the region affected by the compressive force of the web is expanded, and this compressive force P becomes greater than a certain limit value as shown in FIG. 9(*a*). Consequently, web curving WB shown in FIG. 9(*b*) occurs more on the entry side in the rolling direction than in the influence range WR1 (region represented by a dotted pattern) of the web restriction force by the barrel width-variable horizontal roll 1*a* (1*b*). This invites the problems that web curving WB shown in FIG. 9(*b*) remains even after rolling by the finish universal mill and the web is not guided to the normal rolling position due to this web curving WB and an off-center is likely to develop. By the way, this web curving becomes maximum at the center in the transverse direction due to the influences of web restriction at both end portions of the web by the barrel width-variable horizontal roll and web restriction by the flange.

SUMMARY OF THE INVENTION

The present invention is directed to solve the problems described above, and aims at providing a method of rolling a high quality shape steel having a flange and a web which can drastically regulate a web inner width of a rolled material on the on-line basis and stagelessly, without changing any roll tools, and can restrict residual web curving and deterioration of web off-center resulting from web width reduction rolling, and a rolling mill line for the method.

The gist of the present invention resides in the following points.

(1) A rolling method of a shape steel having a flange and a web, comprising the steps of: rough rolling a blank having a rectangular or dog bone-shaped section into a rough rolled material by a breakdown mill; conducting intermediate rolling of the rough rolled material by an intermediate rolling mill comprising a rough universal mill and an edger mill; and finish-rolling the intermediate rolled material by a finish universal mill comprising barrel width-variable horizontal rolls and vertical rolls so as to reduce a web height in a transverse direction through a flange into a predetermined various sizes while the center portion of the web is restricted by a guide mechanism at a position in the proximity of the entry side of the barrel width-variable horizontal rolls, and the axis of the vertical roll is offset in a rolling direction relatively to a roll axis position of the horizontal roll.

(2) A rolling method of a shape steel having a flange and a web according to the item (1), wherein restriction of the center portion of the web is made by a horizontal roller guide or by a friction guide.

(3) A rolling mill line of a shape steel having a flange and a web, comprising: a breakdown mill for rolling a blank having a rectangular or dog bone-shaped section into a rough rolled material; an intermediate rolling mill comprising a rough universal mill and an edger mill, for rolling the rough rolled material into an intermediate rolled material; and a finish universal mill comprising barrel width-variable horizontal rolls and vertical rolls, for finish-rolling the intermediate rolled material; wherein a guide mechanism for restricting the center portion of the web is disposed at a position in the proximity of the entry side of the barrel width-variable horizontal rolls of the finish universal mill, and a roll shaft axis moving mechanism for offsetting the axis of the vertical rolls relatively to the axis of the barrel width-variable horizontal roll is disposed to the vertical rolls.

(4) A rolling mill line of a shape web having a flange and a web according to the item (3), wherein the guide mechanism for restricting the center portion of the web comprises a horizontal roller guide device or a friction guide device, and a hydraulic pressure or screw cylinder is further disposed so as to regulate the gap of the guide device.

BEST MODE FOR CARRYING OUT THE INVENTION

Figure 1:
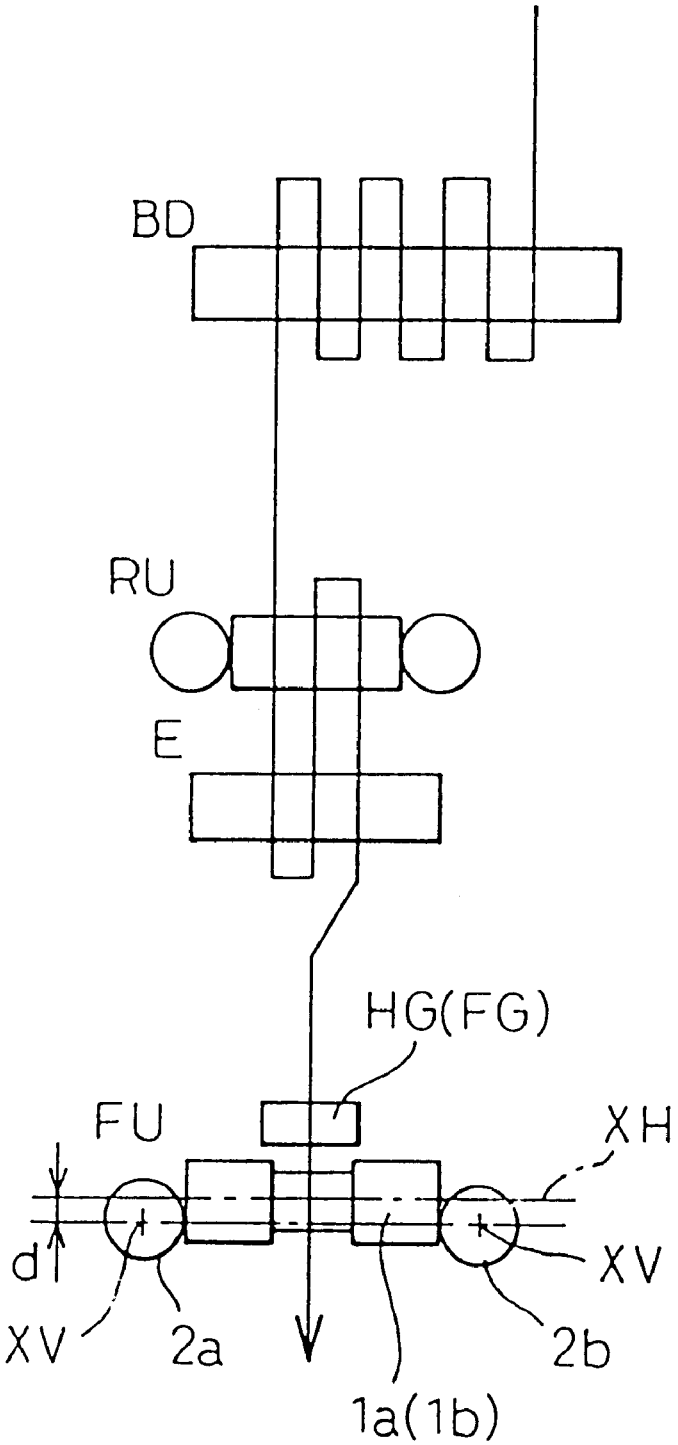
FIG. 1 is a schematic view showing the disposition of a rolling mill line according to the present invention.

FIG. 1 shows an example of disposition of rolling mill lines for carrying out the present invention. A rough rolling step is the one that uses a flat slab having a rectangular section or a dog bone-shaped slab as the blank and rolls it into a dog bone-shaped rough-rolled material by upper and lower horizontal rolls of a breakdown mill BD. An intermediate rolling step rolls and shapes the rough-rolled material into an intermediate rolled material having a substantially H-shaped section by a rough universal mill RU and an edger mill E. These rough rolling step and intermediate rolling step are analogous to a shaping step of a shape steel having a flange, such as an H-shaped steel, that is well known in the art, and the detailed explanation thereof is omitted. Next, a finish rolling step rolls a portion of the intermediate rolled material corresponding to a web in the direction of its width by a finish universal mill FU so that the web height attains a required dimension. A horizontal roller guide device HG or a friction guide device FG is disposed in front, and in the proximity, of the finish universal mill FU, as a guide mechanism for restricting the center portion in the direction of the web width. Here, the horizontal roller guide device includes at least one pair of upper and lower rollers, and a plurality of pairs of rollers may be disposed, whenever necessary. Further, each of these guide devices has a mechanism for setting properly and quickly the gap between the upper and lower rollers or the gap between the upper and lower friction guides by hydraulic pressure or by a screw.

By the way, the finish universal mill FU hereby used is of the type in which the roll shaft axes XV of the vertical rolls 2*a* and 2*b* are moved by a distance d (hereinafter, this d will be called the "vertical roll moving distance") to the roll shaft axis XH of the barrel width-variable horizontal roll 1*a* (1*b*). This disposition example represents a simple example where one each rough universal mill RU and edger mill E are so disposed as to form a pair in the intermediate rolling step, but a plurality of pairs of rolling mills may be disposed as a group whenever necessary from the aspect of productivity, or the like.

Here, the explanation will be given why the horizontal shaft axis and the vertical shaft axis are moved by d in the finish universal mill FU in the present invention.

Figure 2:
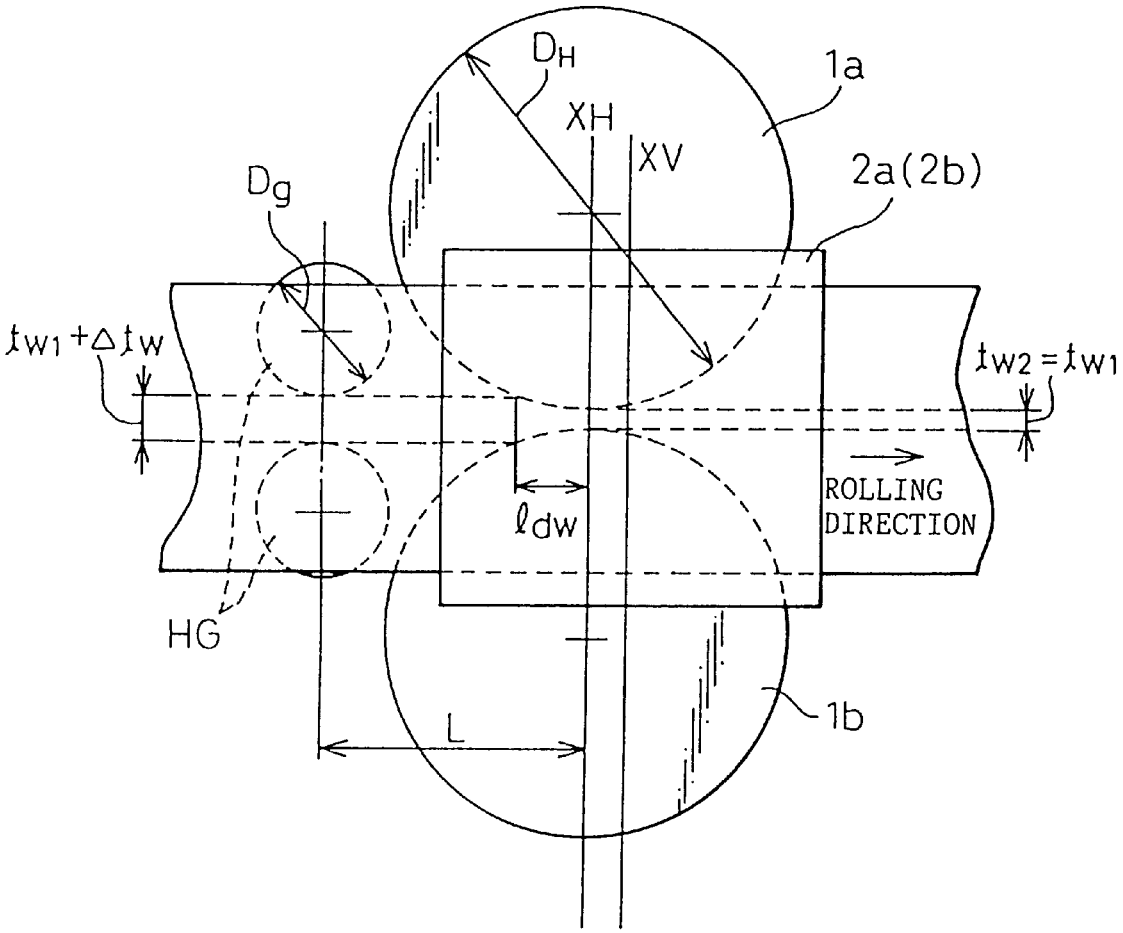
FIG. 2 is a side view showing a web width reduction rolling state when the present invention is applied.
Figure 3:
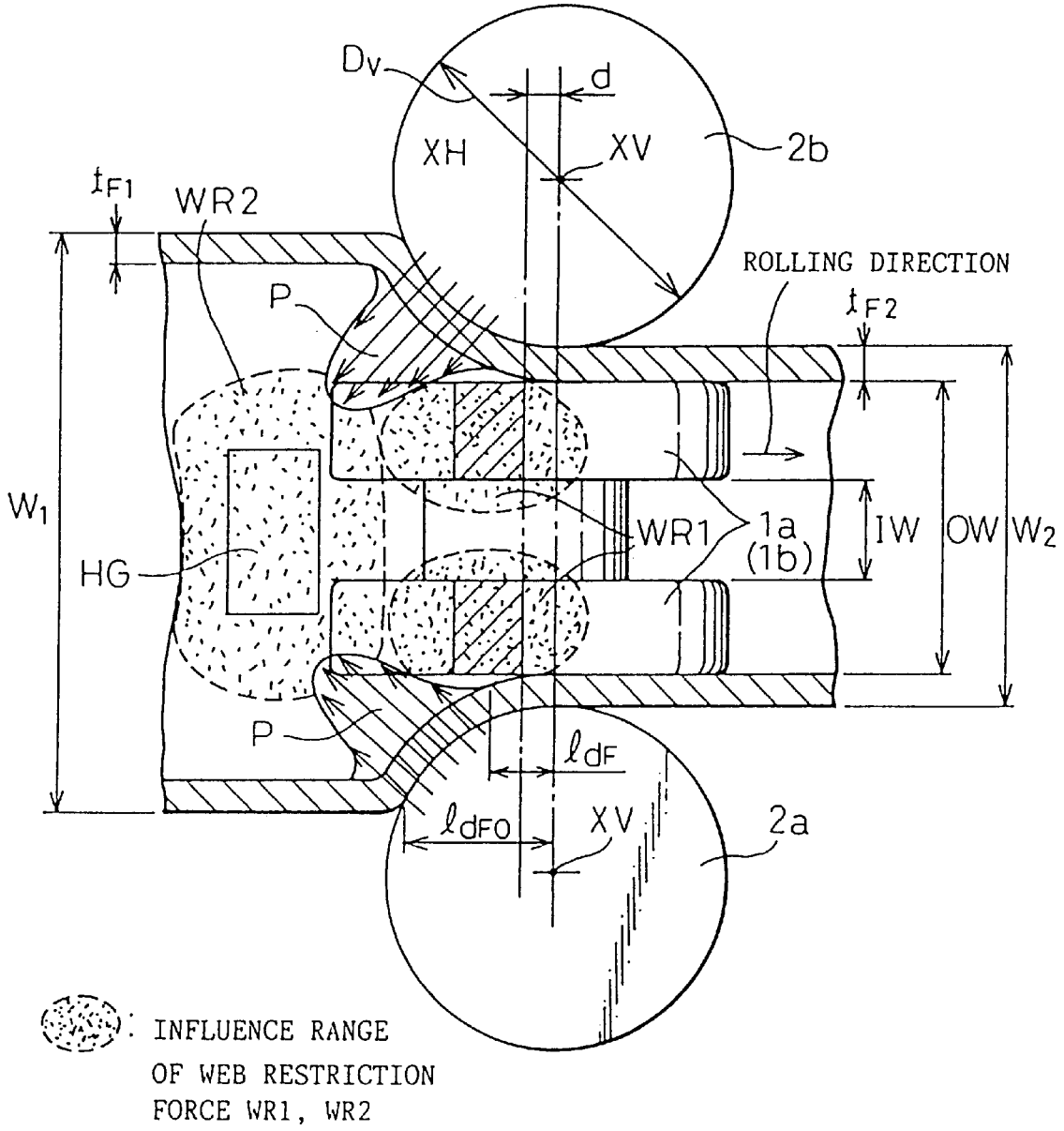
FIG. 3 is a plan view of the web width reduction rolling state when the present invention is applied.
Figure 4A:
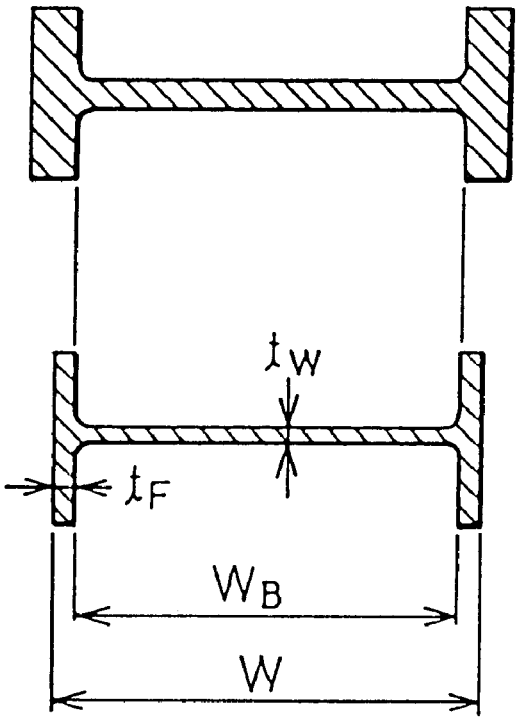
FIG. 4(a) PRIOR ART
FIGS. 4(*a*) and 4(*b*) are sectional views, each showing the product shape of a rolled H-shaped steel.
Figure 4B:
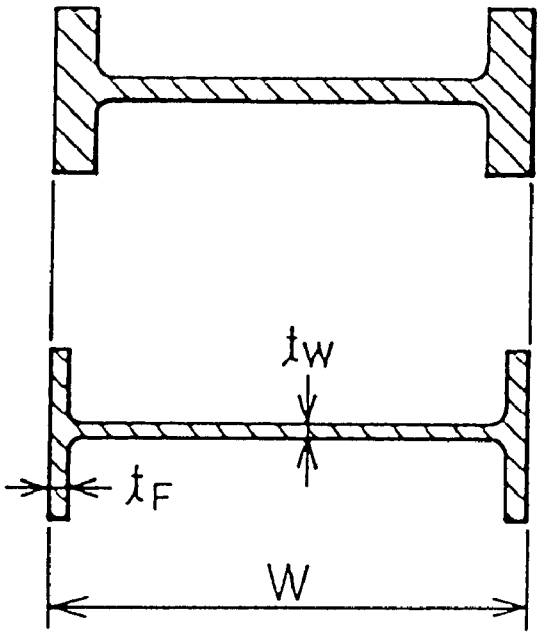
FIG. 4(b) PRIOR ART
Figure 5A:
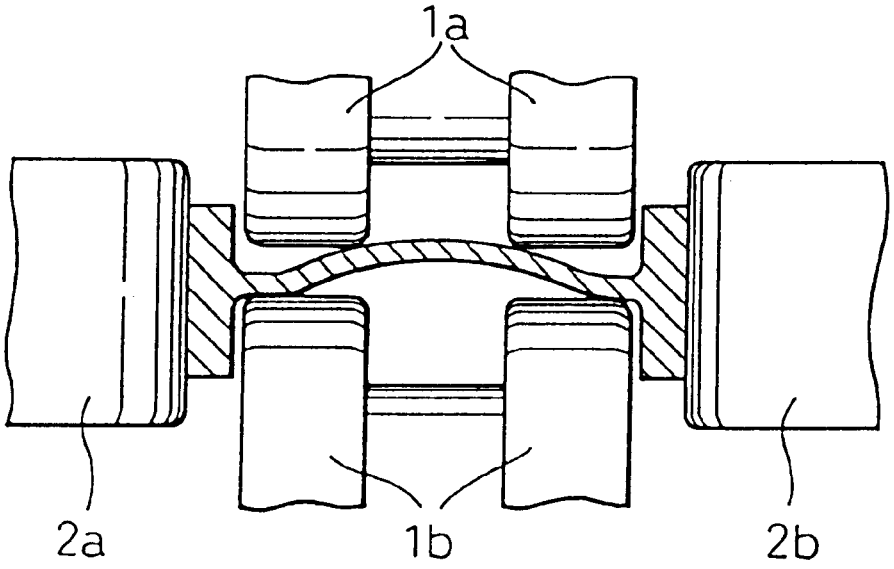
FIG. 5(a) PRIOR ART
FIGS. 5(*a*) and 5(*b*) are explanatory views of an inferior rolling state in a finish rolling process.
Figure 5B:
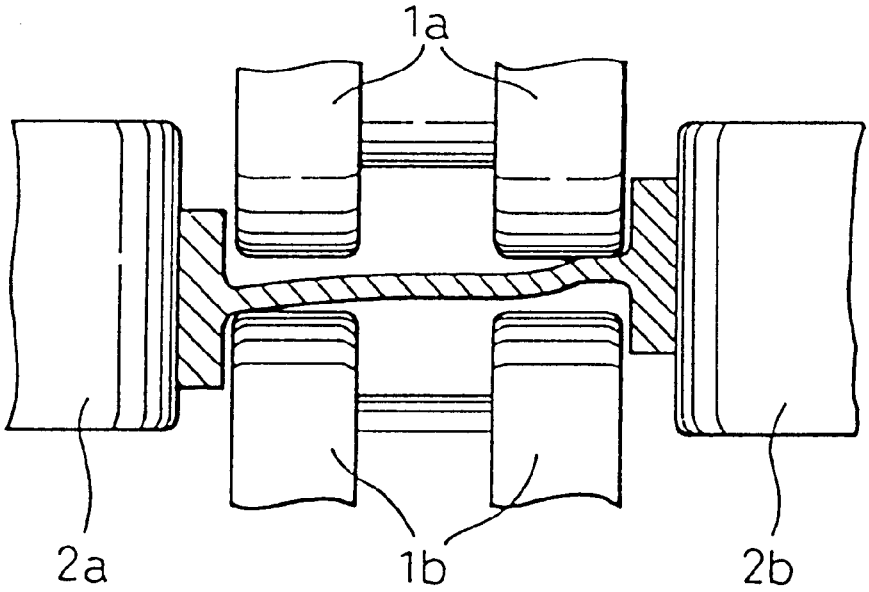
FIG. 5(b) PRIOR ART

In this case, the relation between the shape material catch position of the horizontal roll and the vertical roll and the contact position with the rolls are shown in FIGS. 2 and 3, and can be expressed by the following formulas.

Contact projection length of web at horizontal roll:

$$l_{DW} = \sqrt{R_H \Delta t_w - (\Delta t_w)^2/4} \quad (1)$$

Contact projection length of flange at vertical roll:

$$l_{DF} = \sqrt{2R_V(t_{F1} - t_{F2}) - (t_{F1} - t_{F2})^2} \quad (2)$$

Contact projection length of flange outer surface at vertical roll:

$$l_{dFO} = \sqrt{R_V(W_1 - W_2) - (W_1 - W_2)^2/4} \quad (3)$$

Here, $R_H$: radius of horizontal roll ($\frac{1}{2}D_H$)

$R_V$: radius of vertical roll ($\frac{1}{2}D_V$)

$t_w$: web thickness $t_F$: web outer width (height)

w: web outer width (height)

suffix 1: before finish rolling (intermediate rolled material)

suffix 2: after finish rolling.

Since the present invention basically sets the web thickness $t_{w1}$ before finish rolling (intermediate rolled material) to the web thickness $t_{w2}$ after finish rolling, the web rolling reduction quantity $\Delta t_w$ is apparently zero. In practice, however, the web inner width is reduced by the vertical rolls that act on the web before overall elongating of the flange thickness starts occurring by rolling reduction, and consequently, the web thickness increases. Therefore, the web rolling reduction $\Delta t_w$ occurs on the finish horizontal rolling. On the other hand, the length $l_{dFB}$ ($=l_{dFO}-l_{dw}$) of the compression region outside the flange preceding to the web contact start determines the maximum width reduction quantity in the reduction rolling method. Therefore, when the shaft axis XV of the vertical roll is offset by the distance d towards the rolling delivery side with respect to the shaft axis XH of the horizontal roll, the maximum width reduction quantity can be increased from $\Delta W_o$ to $\Delta W_d$. Here, $$\Delta W_c = 2 \cdot \left(R_v - \sqrt{R_v^2 - (l_{dW} + l_{dFB})^2}\right) \quad (4)$$

$$\Delta W_d = 2 \cdot \left(R_v - \sqrt{R_v^2 - (l_{dW} + l_{dFB})^2 + d)^2}\right) \quad (5)$$

In order to secure stable rolling and quality, it is generally preferred to set the offset quantity d within the range in which the simultaneous reduction regions of the web and the flange exist.

Next, the method of restricting the web curve and the web off-center by using the horizontal roller guide device HG or by the friction guide device FG as the characterizing feature of the present invention will be explained.

The present invention can effectively utilize the web restriction effect by the barrel width-variable horizontal rolls and the web restriction effect by the horizontal roller guide device HG or the friction guide device FG by combining the movement towards the vertical roll rolling delivery side with the horizontal roller guide device HG or the friction guide device FG. In this way, the present invention can make the web width reduction quantity considerably greater than when the movement towards the roll rolling delivery side is used alone.

FIGS. 2 and 3 show the web width reduction rolling state when the horizontal roller guide device HG of the present invention is applied. FIG. 2 is a side view and FIG. 3 is a plan view. From the aspect of the design strength, the roller diameter Dg of the horizontal roller guide device HG must be at least about 150 mm, whereas the diameter DH of the barrel width-variable horizontal roll is about 1,400 mm. To avoid their mutual interference, therefore, the distance L from the position immediately below the barrel width-variable horizontal roll to the position immediately below the roller of the horizontal roller guide device must be at least about 500 mm with some margin. Therefore, the web is physically under the non-restricted state from the position immediately below the roller of the horizontal roller guide device to the position before the web is rolled by the barrel width-variable horizontal roll. The present invention can be applied in the cases inclusive of the case where the width reduction of the web is effected to a considerably large extent and the influences of the compressive force P spread to the rolling entry side. At this time, the present invention delays as much as possible the web width reduction by the vertical rolls to the rolling delivery side, restricts the web by the barrel width-variable horizontal rolls, installs the horizontal roller guide device HG at the position at which it does not interfere with the barrel width-variable horizontal rolls, and carries out the web width reduction rolling by the vertical rolls while the web is being restricted by the horizontal roller guide device HG. In this way, the influence ranges WR1 and WR2 of the two web restriction forces can cover the influence range of the compressive force P even under a considerably large web width reduction rolling condition, and web width reduction rolling can be carried out more than ever without inviting web curving and center deviation.

Incidentally, the both end portions of the web are out of the influence ranges (WR1, WR2) of the web restriction force by the guide mechanism in FIG. 3. In pracitce, however, web curving and web buckling do not occur because both end portions are affected by the web restriction force by the flange, and the restriction of only the center portion of the web in its transverse direction is sufficient. Practically, the width of the horizontal roller guide device HG may be set within the range from the inner width IW to the outer width OW of the width-variable horizontal rolls.

Web curving and web off-center can be restricted by applying the friction guide device FG of the present invention, too, by the similar operation, and web width reduction can be carried out more than in the prior art. The horizontal roller guide device HG is more advantageous in order to prevent seizure flaws and scratches of the product, but the friction guide device FG is more advantageous from the aspect of restriction of the web because the distance L from the position immediately below the roll of each of the barrel width-variable horizontal rolls 1*a*, 1*b* to the distal end of the friction guide device FG can be made smaller than that of the horizontal roller guide device HG. For this reason, a friction guide device having improved seizure resistance by introducing advanced technologies such as ceramic coating or local concentrated lubrication method may be employed.

The present invention will be explained in further detail with reference to Examples thereof.

EXAMPLES

This example was directed to H-shaped steels of a product series H550×200 (web height×flange width). In this Example, the range of the flange thickness for attaining the constant height of the web by the same roll set within the same product series was expanded more greatly than in the prior art. In other words, blanks corresponding to the products sizes of (6 mm×9 mm), (6 mm×12 mm), (6 mm×16 mm), (9 mm×16 mm), (9 mm×19 mm), (9 mm×22 mm), (12 mm×16 mm), (12 mm×19 mm), (12 mm×22 mm), (12 mm×25 mm), (14 mm×25 mm), (14 mm×28 mm), (16 mm×28 mm), and (16 mm×32 mm), in terms of the web thickness and the flange thickness, were rolled to a required thickness by the intermediate rolling step. Then, the gap of the vertical rolls of the finish universal mill was set so that the web height of all the series was coincident with the web height, i.e. 550 mm, of the H-shaped steel having the smallest thickness (6 mm×9 mm), and the roll width of the barrel width-variable horizontal rolls was so set as to correspond to each flange thickness. At this time, the flange thickness of each intermediate rolled material was calculated so that the flange rolling reduction ratio at the finish rolling step was substantially equal to the web rolling reduction ratio, and the vertical rolls of the rough universal mill were set.

According to the rolling method of the prior art, web width reduction could be done (web width reduction quantity: about 32 mm) within the range in which the tolerance could be satisfied, up to the product sizes of (6 mm×16 mm), (9 mm×19 mm), and (12 mm×25 mm). In the product sizes exceeding this range, however, web curving remained unremoved and web off-center was outside the product tolerance.

In the rolling method according to the present invention, on the other hand, the vertical roll moving distance d was set to 100 mm, the roller gap of the horizontal roller guide device was set to the web thickness of the intermediate rolled material, and the distance L from the position immediately below the barrel width-variable horizontal roll to the position immediate below the roller of the horizontal roller guide device was set to 500 mm. In this way, rolling could be carried out without any problem to the product size up to (16 mm×32 mm), (web width reduction quantity: approx. 46 mm). similarly, rolling could be carried out without any problem up to the product size (16 mm×32 mm), (web width reduction quantity: approx. 46 mm) by setting the vertical roll moving distance d to 100 mm and the gap of the friction guide device, which was disposed almost immediately below the width-variable horizontal roll, to the sum of the web thickness of the intermediate rolled material plus 2 mm.

Figure 6:
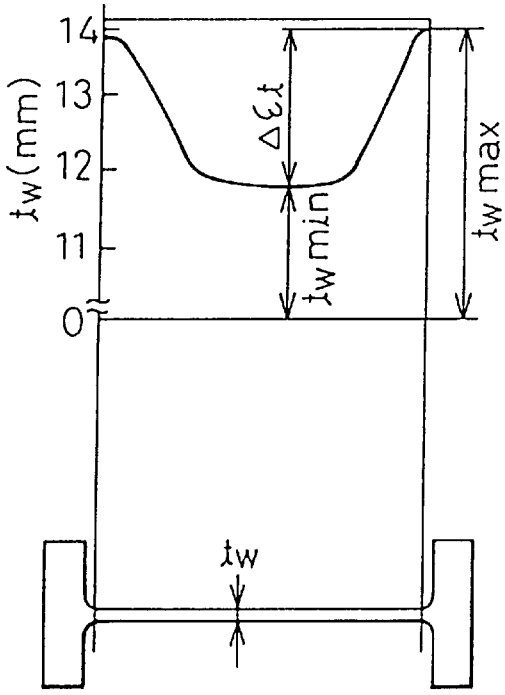
FIG. 6 PRIOR ART
FIG. 6 is an explanatory view of the state of occurrence of a non-uniform thickness in the section of an H-shaped steel according to the prior art method.
Figure 7:
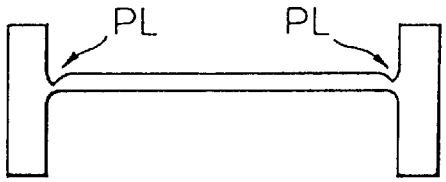
FIG. 7 PRIOR ART
FIG. 7 is a sectional view of an H-shaped steel in which folding occurs at a fillet portion.
Figure 8:
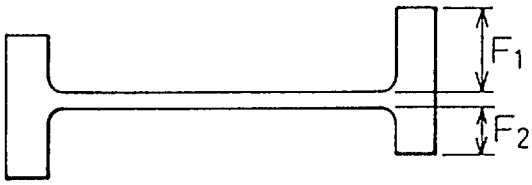
FIG. 8 PRIOR ART
FIG. 8 is a sectional view of an H-shaped steel in which dimensional/shape defects occur.
Figure 9A:
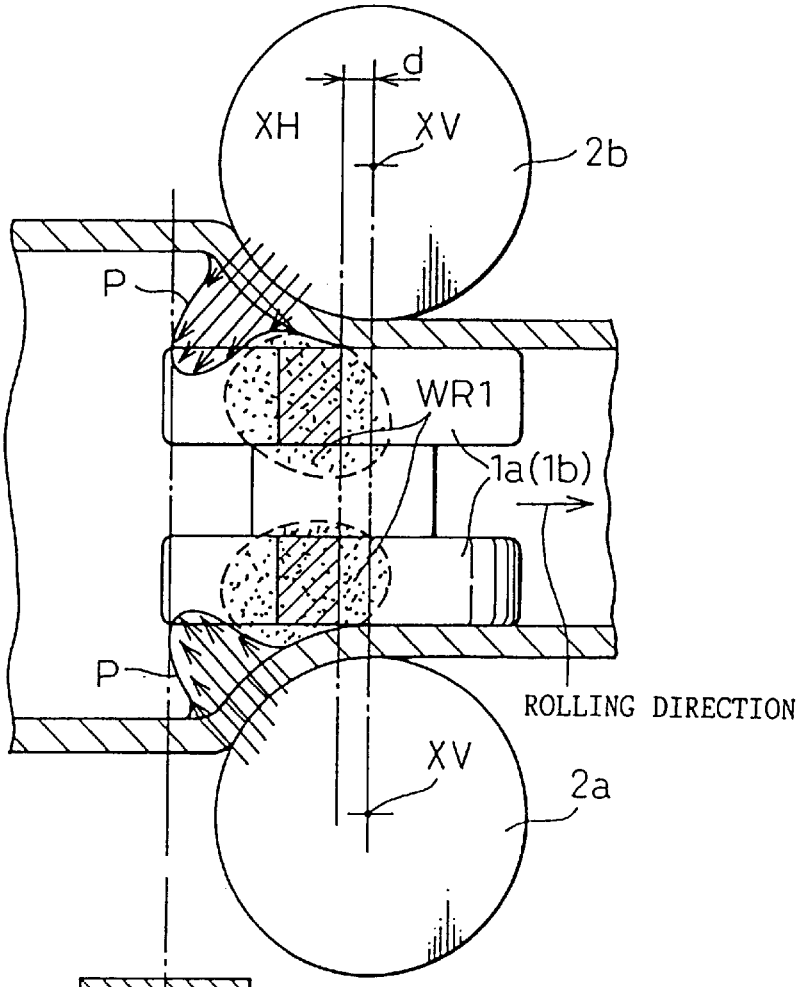
FIG. 9(a) PRIOR ART
FIGS. 9(*a*) and 9(*b*) are explanatory views of the state of occurrence of web curving of an H-shaped steel according to the prior art method.
Figure 9B:
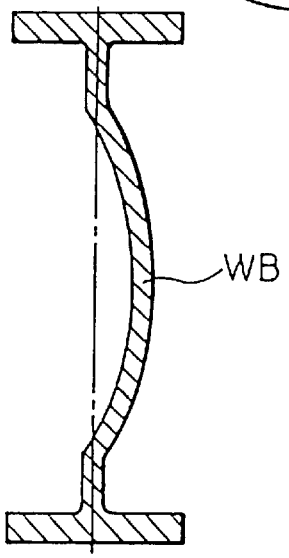
FIG. 9(b) PRIOR ART

In another example, the axis of the vertical roll shaft was moved towards the rolling delivery side, and the increase of the thickness at both end portions of the web occurring during the web width reduction rolling process at the ordinary levels of setting of the barrel width-variable horizontal roll gap and the flange rolling reduction ratio, could be eliminated, and non-uniformity inside the section of the product sheet thickness shown in FIG. 6 (sheet thickness error $\Delta\epsilon_t = t_{Wmax} - t_{Wmin}$) could be eliminated, too.

In this example, the values $\Delta W_o$ and $lW_d$ of the formulas (4) and (5) were $\Delta W_o = 20$ mm and $\Delta W_d = 32$ mm as the maximum width reduction quantity, and the roll dimensions at this time were the radius of the horizontal roll of 650 mm, the radius of the vertical roll was 490 mm, and the offset quantity (d) between both rolls was 27 mm.

INDUSTRIAL APPLICABILITY

When web width reduction rolling of a shape steel having a flange and a web is carried out, the present invention can increase the web width reduction quantity more than in the prior art without inviting web curving and web off-center. Therefore, the present invention can further enlarge the range of the flange thickness, in which the web height can be attained by the same roll set in the same product series, more than in the prior art.

What is claimed is:

1. A rolling method of a shape steel having a flange and a web with a center portion, comprising the steps of:

rough rolling a blank having a rectangular or dog bone-shaped section into a rough rolled material by a breakdown mill;

conducting intermediate rolling of said rough rolled material by an intermediate rolling mill comprising a rough universal mill and an edger mill; and finish rolling said intermediate rolled material by a finish universal mill comprising barrel width-variable horizontal rolls having an entry side and vertical rolls having an axis so as to reduce a web height in a transverse direction through a flange into predetermined various sizes while the center portion of said web is restricted by a guide mechanism at a position in the proximity of the entry side of said barrel width-variable horizontal roll, and the axis of said vertical roll is offset in a rolling direction relative to a roll axis position of said horizontal roll.

2. A rolling method of a shape steel having a flange and a web according to claim 1, wherein restriction of the center portion of said web is made by a horizontal roller guide or by a friction guide.

3. A rolling mill line of a shape steel having a flange and a web with a center portion, comprising:

a breakdown mill for rolling a blank having a rectangular or dog bone-shaped section into a rough rolled material;

an intermediate rolling mill comprising a rough universal mill and an edger mill, for rolling said rough rolled material into an intermediate rolled material; and a finish universal mill comprising barrel width-variable horizontal rolls having an entry side and an axis and vertical rolls having an axis, for finish-rolling said intermediate rolled material;

wherein a guide mechanism for restricting the center portion of said web is disposed at a position in the proximity of the entry side of said barrel width-variable horizontal roll of said finish universal mill, and a roll shaft axis moving mechanism for offsetting the axis of said vertical roll relative to the axis of said barrel width-variable horizontal roll in a rolling direction is connected to said vertical roll.

4. A rolling mill line of a shape web having a flange and a web according to claim 3, wherein said guide mechanism for restricting the center portion of said web comprises a horizontal roller guide device or a friction guide device having a gap, and a hydraulic pressure or screw cylinder is further disposed so as to regulate the gap of said guide device.

* * * * *